US005675144A

United States Patent [19]

Focke et al.

[11] Patent Number: 5,675,144

[45] Date of Patent: Oct. 7, 1997

[54] APPARATUS FOR VERIFYING THE CORRECT FORMATION OF THE TWO OPPOSITE ENDS OF CIGARETTES IN A CIGARETTE MAGAZINE

[75] Inventors: Heinz Focke, Verden; Dietrich Below, Bülstedt, both of Germany

[73] Assignee: Focke & Co. (GmbH & Co.), Verden, Germany

[21] Appl. No.: 446,746

[22] PCT Filed: Jan. 29, 1995

[86] PCT No.: PCT/EP94/00260

§ 371 Date: Jun. 22, 1995

§ 102(e) Date: Jun. 22, 1995

[87] PCT Pub. No.: WO94/18074

PCT Pub. Date: Aug. 18, 1994

[30] Foreign Application Priority Data

Feb. 2, 1993 [DE] Germany ..... 43 02 777.6

[51] Int. Cl.[6] ..... G01N 21/89; B65B 19/00

[52] U.S. Cl. ..... 250/223 R; 209/356

[58] Field of Search ..... 250/223 R, 222.1, 250/221, 559.21, 559.22, 559.27, 559.4, 559.46, 559.45; 209/535, 536

[56] References Cited

U.S. PATENT DOCUMENTS

| | | | |
|---|---|---|---|
| 4,678,901 | 7/1987 | Focke et al. | 250/223 R |
| 4,931,633 | 6/1990 | Focke et al. | 250/223 R |
| 4,944,314 | 7/1990 | Bolt . | |
| 4,955,948 | 9/1990 | Focke et al. | 250/223 R |
| 5,000,323 | 3/1991 | Cahill et al. | 250/223 R |
| 5,406,376 | 4/1995 | Maiwald et al. | 250/223 R |

FOREIGN PATENT DOCUMENTS

| | | |
|---|---|---|
| 307661 | 3/1989 | European Pat. Off. . |
| 338241 | 10/1989 | European Pat. Off. . |
| 3304299 | 9/1983 | Germany . |
| 3620735 | 12/1987 | Germany . |
| 3628088 | 2/1988 | Germany . |
| 3640491 | 6/1988 | Germany . |
| 3808964 | 10/1988 | Germany . |
| 3725366 | 2/1989 | Germany . |
| 3729213 | 3/1989 | Germany . |
| 3812689 | 11/1989 | Germany . |
| 4000658 | 8/1990 | Germany . |
| 4102433 | 8/1991 | Germany . |
| 4217938 | 12/1992 | Germany . |
| 2221032 | 1/1990 | United Kingdom . |

OTHER PUBLICATIONS

JP 58=156841 A., In: Patent Abstracts of Japan, P–242, Dec. 10, 1983, vol. 7, No. 278.

*Primary Examiner*—Edward P. Westin
*Assistant Examiner*—John R. Lee
*Attorney, Agent, or Firm*—Sughrue, Mion, Zinn, Macpeak and Seas

[57] ABSTRACT

The ends of cigarettes (10) are verified in a cigarette magazine (12) by testing units (24, 25) coordinated with the ends of cigarettes (10) at a testing level (20). The testing units (24, 25) consist of mutually adjacent and removable testing elements (33) with transmitters (28, 29) and planar receivers (30, 31) at the sides of the cigarettes. The testing units (24, 25) are fitted so that they can move parallel to the axis of the cigarettes (10) relative to the cigarette magazine (12), so that the testing unit (25) can moved back in order to advance the cigarettes from the cigarette magazine (12).

13 Claims, 5 Drawing Sheets

APPARATUS FOR VERIFYING THE CORRECT FORMATION OF THE TWO OPPOSITE ENDS OF CIGARETTES IN A CIGARETTE MAGAZINE

BACKGROUND OF THE INVENTION

The invention relates to a device for verifying the ends of cigarettes in the region of upright test channels in which respective individual cigarette rows of superimposed cigarettes are moved from the top to the bottom with their laterally directed ends, especially in a cigarette magazine of a packaging machine, wherein, in the region of a testing level, on at least one side of the test channels, a testing unit is arranged having sensors, specifically transmitters and receivers for transmitting and receiving a test beam in the region of end faces of a test group of cigarettes, and their adjacent side faces.

Such a verifying device is the subject matter of EP-A-0 338 241. The object is to verify the two end regions of cigarettes for correct formation, specifically for a proper filling of tobacco and, if appropriate, the presence of a filter. Defective cigarettes are identified and ejected from the cigarette magazine. Inside the cigarette magazine, at a testing level, one testing unit is located on both sides. This testing unit is equipped with transmitters and receivers. The transmitters direct light onto the end faces of cigarettes of a test group. In a region adjacent to the end faces, at both sides of the cigarettes to be tested, receivers are arranged which receive the light passing through the side faces, and thus through the cigarette paper. Too much outputted light is an indication for a defective formation of the cigarette. In the known apparatus, two superimposed sensors are arranged as receivers at both sides of each cigarette to ensure a verification that is as accurate as possible.

SUMMARY OF THE INVENTION

The invention is based on the object to further develop and improve a verifying device in this or in a similar embodiment as regards arrangement and design of the sensors, and regarding the structural design of the testing unit in view of a simplified design and handling, and a more reliable verification.

To attain this object, the apparatus according to the invention is characterized in that light-sensitive receivers respectively extend over the region of a test group with a plurality, especially two superimposed cigarettes, and receive the light radiating from each cigarette of a test group, preferably in the region of the side faces.

In the apparatus according to the invention, the cigarettes of a test group, preferably two respective superimposed cigarettes, are assigned receivers which extend as a unit or as a uniform member over the region of (both of) the cigarettes. Thereby it is ensured that a greater receiving surface is available for the light which (laterally) radiates from the cigarettes. As a result, the verification is more precise.

The receivers, according to a further feature of the invention, are planar silicon photoelements, which are also known as solar cells.

According to the invention, the verification is carried out in such a manner that first one and then the other cigarette is subjected to the test beam (light) during a test cycle. The planar receiver, which is common for both cigarettes, is thus first subjected to the light of the one, and then to the light of the other cigarette.

A further particularity of the invention relates to the design of the testing unit. The testing unit is movable in cycles transversely relative to the test channels, or in the longitudinal direction of the cigarettes. For the downwardly directed transport of the cigarettes after a test cycle, the testing unit is moved back so that the cigarettes can be advanced without hindrance. For the test cycle, the testing unit is advanced to the ends of the cigarettes.

A further particularity is that the testing unit is comprised of individual testing members which are assigned to one cigarette each, or to a test group thereof. The testing members with a U-shaped ground plan, each of which being provided with the sensors required for a testing unit, are assembled adjacent to one another to form a testing unit, specifically with easily releasable connecting members. As a result, the assembly of the testing unit is simplified. Furthermore, a later replacement, repairing, and cleaning of individual testing members is possible.

According to an advantageous embodiment of the invention, a positioning unit for the flexible and individual exertion of pressure on the cigarettes in the longitudinal direction thereof is arranged at one side of the test channel or the cigarette magazine. As a result it is possible to compensate tolerances in the length of the cigarettes during the testing of the same, by flatly adjoining the cigarettes, specifically the ends of the cigarettes, to the testing unit under slight pressure. Gaps, which may be formed between the cigarette and the testing unit as a result of tolerances in length, and which may divert external light to the receivers of the testing unit, are suppressed or avoided with the help of the positioning unit. As a result, the verification of the cigarettes is even more accurate.

Further details of the invention relate to the design of the testing members and their sensors, as well as to the testing unit and the actuation thereof.

Exemplary embodiments of verifying devices according to the invention will be explained in more detail hereinbelow with reference to the drawings. In these:

DESCRIPTION OF PREFERRED EMBODIMENTS

Figure 1:
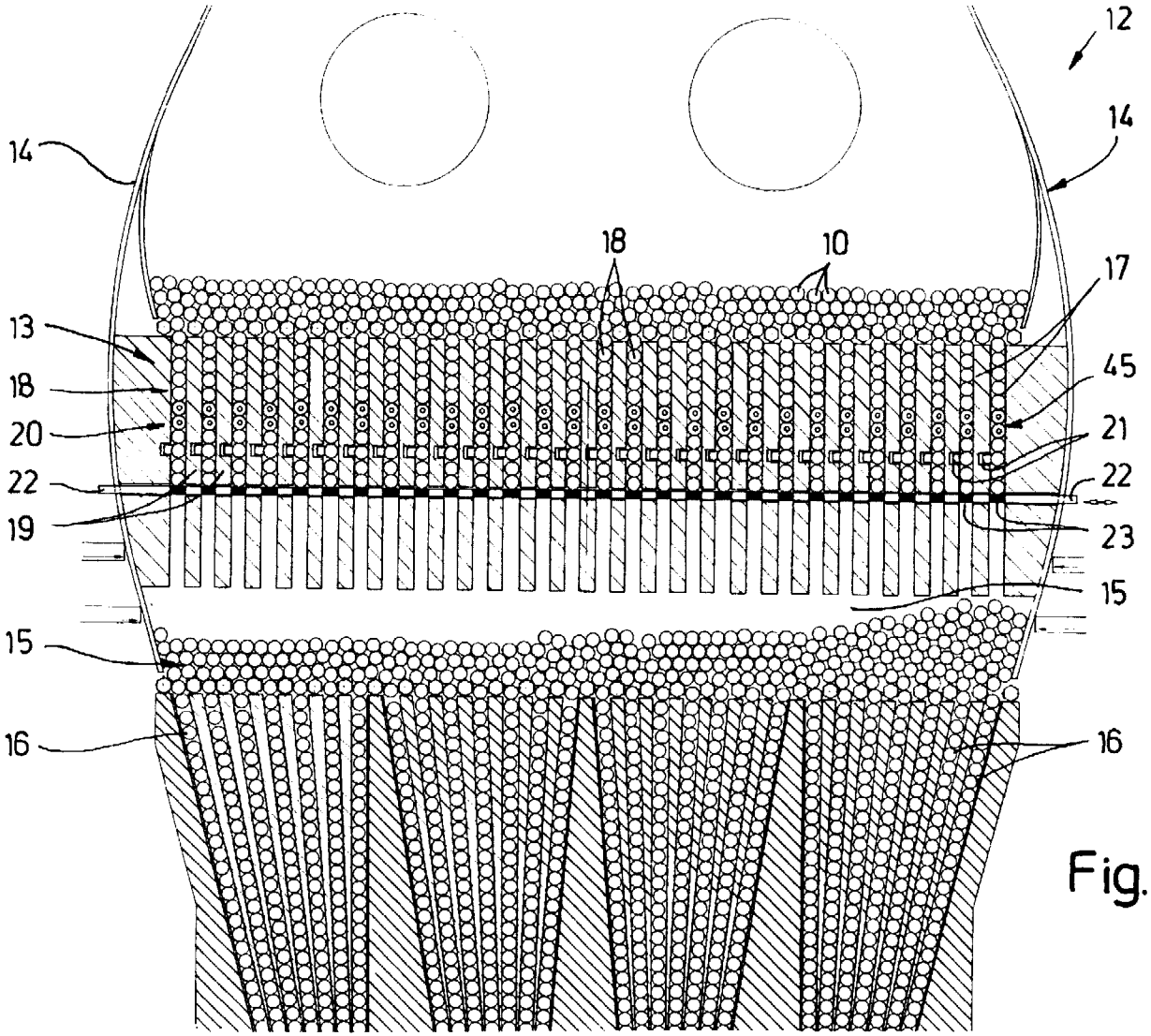
FIG. 1 shows a vertical section of a part of a cigarette magazine.

The details shown in the drawings relate to the verification of cigarettes 10 with a filter 11 for the correct formation of the end regions. The cigarettes 10 are inserted into a cigarette magazine 20 in disorder, but aligned in parallel position. This cigarette magazine approximately corresponds to the cigarette magazine according to EP-A-0 338 241 in its basic structure. Inside the cigarette magazine 12, the cigarettes run through a test area 13 which is arranged in the broadest place within a magazine housing 14 converging in the upright and downward direction. The tested and intact cigarettes 10 reach into a collecting chamber 15 below the test area 13. From here, the cigarettes are inserted into upright magazine shafts 16. At the lower end of the magazine shafts 16, which form groups, the cigarettes 10 are ejected as cigarette groups corresponding to the content of a pack.

The test area 13 also consists of a number of upright shafts or test channels 17 arranged parallel to one another. The width of the test channels is slightly greater than the diameter of a cigarette so that inside of the test channels 17 respective cigarette rows 18 of individual superimposed cigarettes are formed. The cigarettes 10 or the cigarette rows 18 are moved downwards inside the test channels as a result of their own weight. The test channels 17 are separated from one another by means of web-like channel walls 19.

The cigarettes 10 are verified in the region of a testing level 20 of the test area 13. During a test cycle, a plurality of superimposed cigarettes 10 are verified in each test channel 17. In the present case, this test group 45 consists of two superimposed cigarettes 10. The arrangement is chosen such that the cigarettes 10 are fixed within the test channels 17 so that the verification can be carried out during an accurate rest position of the cigarettes 10. For this purpose, holding members are provided for the cigarettes 10 in the test channels 17 below the test plane, in particular elongate clamping members, specifically clamping fingers 19. As a result, the part of the cigarette rows 18 located above is also positioned.

At a distance below the horizontal plane formed by the clamping fingers 21, a movable supporting member for the cigarettes 10 is arranged, specifically a comb 22, which extends transversely through the test area 13, having webs 23 assigned to each test channel 17. The comb 22 is displaceable to-and-fro as a unit in a horizontal plane. In the one position (FIG. 1), the webs 23 are located in the region of the test channels 17. The cigarette rows 18 located above the comb 22 are supported by the webs 23. In this position, and thus in one of two regions formed by two exposed cigarettes 10, possibly defective cigarettes 10 are ejected by means of members not shown in detail, which take effect in the longitudinal direction of the cigarettes.

By displacing the comb 22 into the other position, the test channels 17 are downwardly opened. The webs 23 are then located in the region of the channel walls 19 (which are provided with interruptions). Gaps which are formed between the webs 23 are located congruently within the test channels 17. The verified and intact cigarettes 10 can now fall into the collecting chamber 17. The test channels 17 extend downwardly beyond the plane of the comb 22 by correspondingly dimensioned or extended channel walls 19.

The cigarettes 10 are verified for the correct formation of the end regions by means of a specially designed testing device at the testing level 20. In the exemplary embodiment according to FIG. 2, the testing device comprises two testing units 24, 25, which are arranged at both sides of the cigarette magazine 12. The testing units 24, 25 form upright depressions or recesses 26 similar to the apparatus according to EP-A-0 338 241. The cigarettes 10 enter into these upright recesses 26 with one end region each during the downward movement. This end region is then verified in a test cycle.

For verifying the cigarettes 10, each cigarette 10 or each cigarette end is assigned special sensors. Adjacent to each end face 27 of the cigarettes 10 there is located a sensor, in particular a transmitter 28, 29. This transmitter emits a test beam, specifically a beam of light in the longitudinal direction of the cigarette 10 to be tested. Furthermore, the cigarettes 10 are assigned sensors arranged on both sides which take effect as receivers 30, 31. These receivers are designed and arranged in a special manner. These receivers are planar or plate-shaped, light-sensitive sensors, in particular silicon photoelements in planar technique. They receive light over their entire surface, so that a wide measuring range is available.

A further particularity consists in the fact that a common receiver 30, 31 is available for the two cigarettes 10 of the test group 45 on each opposing side. The verification is expediently carried out in such a manner that during a test cycle the two cigarettes 10 of the test group are verified in successive steps, so that the receivers 30, 31 are respectively available to one cigarette. This leads to a particularly accurate verification, in particular to the distinction between cigarettes which are still considered as being correct, and cigarettes which are defective.

Regarding the structure, the testing units 24 and 25 are designed in a special manner. The individual testing members are releasably or removably fixed on an elongate carrier 32, which, in the present case, is designed like an irregular double-T profile. Each test group comprising (two) cigarettes is assigned such a testing member 33. A number of testing members corresponding to the number of the test channels 45 is thus arranged next to one another on each testing unit 24, 25.

The testing members 33 are designed with a U-shaped ground plan or cross section. On the side facing the cigarettes 10, two legs 35, 36 are arranged on a body 34, which laterally limit the recess 26, and thus extend next to the ends of the cigarettes 10. The testing members 33 may consist of a castable, hardened material, e.g. of plastic. The sensors, specifically transmitters 28, 29, on the one hand, and receivers 30, 31, on the other, are embedded in the testing member 33. The two transmitters 28, 29 are located in the body 34, and the two receivers 30, 31 with one part in the region of the body 34, and with another part in the region of the legs 35, 36. The material of the testing members 33 is translucent, so that the transmitter 28, 29 and/or receiver 30, 31 may be embedded with a material overlap. The sensors are thereby protected against mechanical influences and especially against soiling, without impairing their effectiveness.

Each testing unit 24, 25 is equipped with a number of testing members 33 which corresponds to the number of test groups 45 to be simultaneously verified. These testing members 33 are fixed on the carrier 32 adjacent to one another in a row. The testing members 33 are dimensioned such that they are arranged in close proximity with respect to the distances between the rows of cigarettes 18.

The testing members 33 are positioned in a depression 37 of the carrier 32 with the body 34. The testing members 33 are connected to one another and to the carrier 32 by means of releasable connecting means, in particular to an upright profile web 38 of the carrier 32. The U-profiles 39 serve for connecting the testing members 33 to one another. The U-profiles embrace two respective adjacent legs 35, 36 of neighboring testing members 33 with their flanges. The legs 35, 36 are provided with recesses for this purpose so that the U-profile 39 lies flush with the free surfaces of the legs 35, 36. The U-profiles 39 on their part are attached to the carrier 32, specifically to the profile web 38 thereof by holding means. These holding means are screws 40 which extend in the region of a separating plane between adjacent testing members 33 from the free side of the U-profile 39 to the profile web 38, and are anchored therein with a screw thread. The screws are designed with a countersunk head, so that the surfaces of the U-profiles facing the channel walls 19 are smooth. Two respective superimposed screws 40 serve for anchoring the U-profiles 39 in the profile web 38.

On the side of the carrier 32 opposing the testing members 33, the former is provided with a cavity 41 extending in the longitudinal direction. The cavity 41 is closed on the outside by a cover 42. The channel-like cavity 41 can serve for electrical members, as for example wires for the connection with wires embedded in the body 34 and leading to the sensors 28 to 31.

Figure 2:
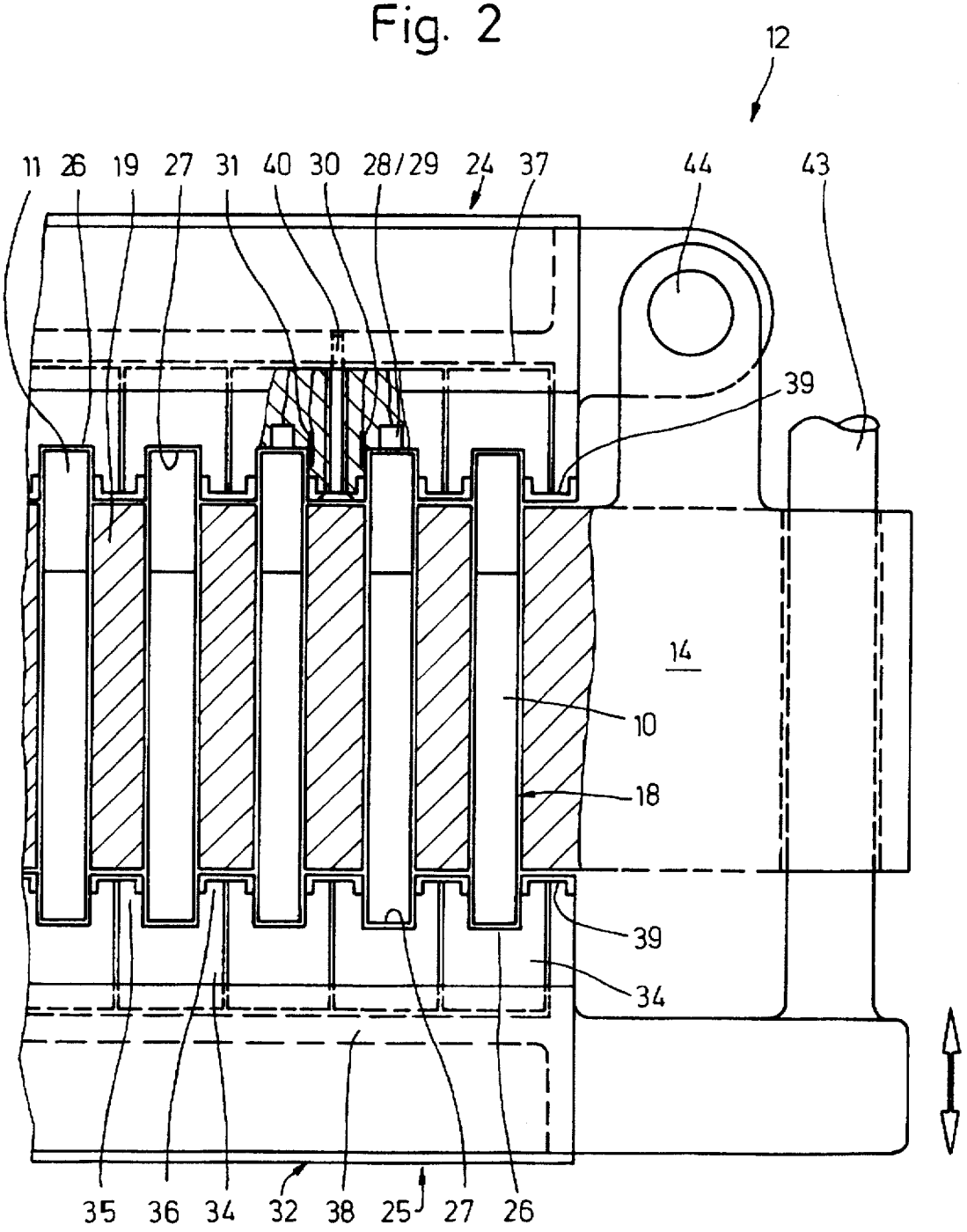
FIG. 2 shows a region of a testing level inside of the testing unit, on a greatly enlarged scale.
Figure 3:
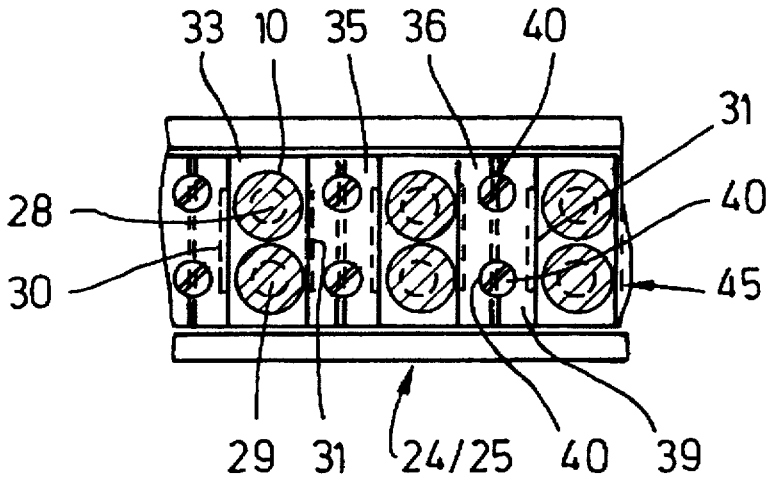
FIG. 3 shows a front view of a detail of a verifying device, specifically a section of an elongate testing unit.
Figure 4:
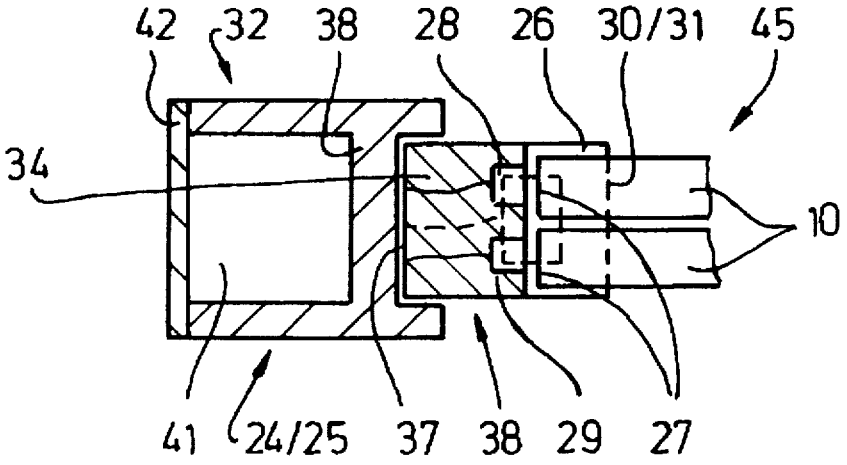
FIG. 4 shows a cross section of the detail according to FIG. 3.
Figure 5:
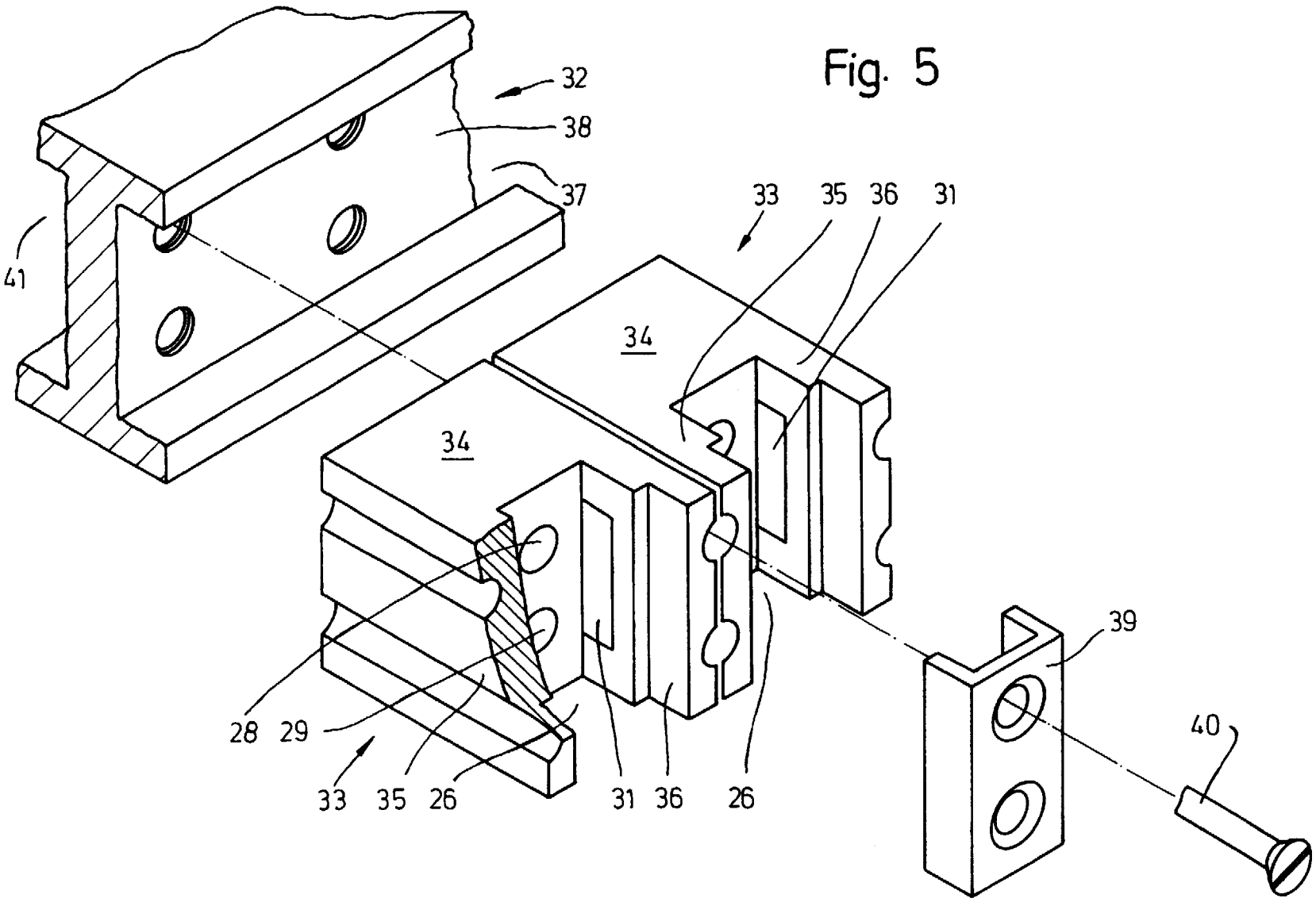
FIG. 5 shows a perspective exploded view of a part of the testing unit, on an even more enlarged scale.

A further particularity consists in the movable arrangement of the testing units 24, 25. At least one of the two testing units, testing unit 25 in the embodiment according to FIG. 2, is movable in a horizontal plane, in particular transversely relative to the cigarette magazine 12, and thus in the longitudinal direction of the cigarettes 10. For this purpose, the carrier 32 is displaceably mounted on both ends with guide rods 43 via an extension in a part of the magazine housing 14. The testing unit 25 can be lifted off or moved back from the cigarette magazine by an actuating member which is not shown, such that the ends of the cigarettes are exposed. During this position of the testing unit 25, the cigarettes in the test channels 17 can be moved downwards without hindrance. During the verification of the cigarettes 10, the testing unit is located in the position according to FIG. 2 while adjoining the cigarette magazine 12, the ends of the cigarettes 10 entering into the recesses 26.

The opposing testing unit 24 may be displaceably arranged in the same manner. In the present exemplary embodiment, however, the testing unit 24 is unalterably retained in the position at the cigarette magazine 12 (testing position). The testing unit 24, however, is mounted with one end in a pivot bearing 44. The testing unit 24 can be pivoted about the pivot bearing 44, and thus lifted off from the cigarette magazine 12. The pivot bearing 44 is arranged laterally of or at the end of the carrier 32, so that the testing unit 24 can be totally moved back from the cigarette magazine as a whole, so that all testing members 33 are exposed for cleaning or repairing purposes.

Figure 6:
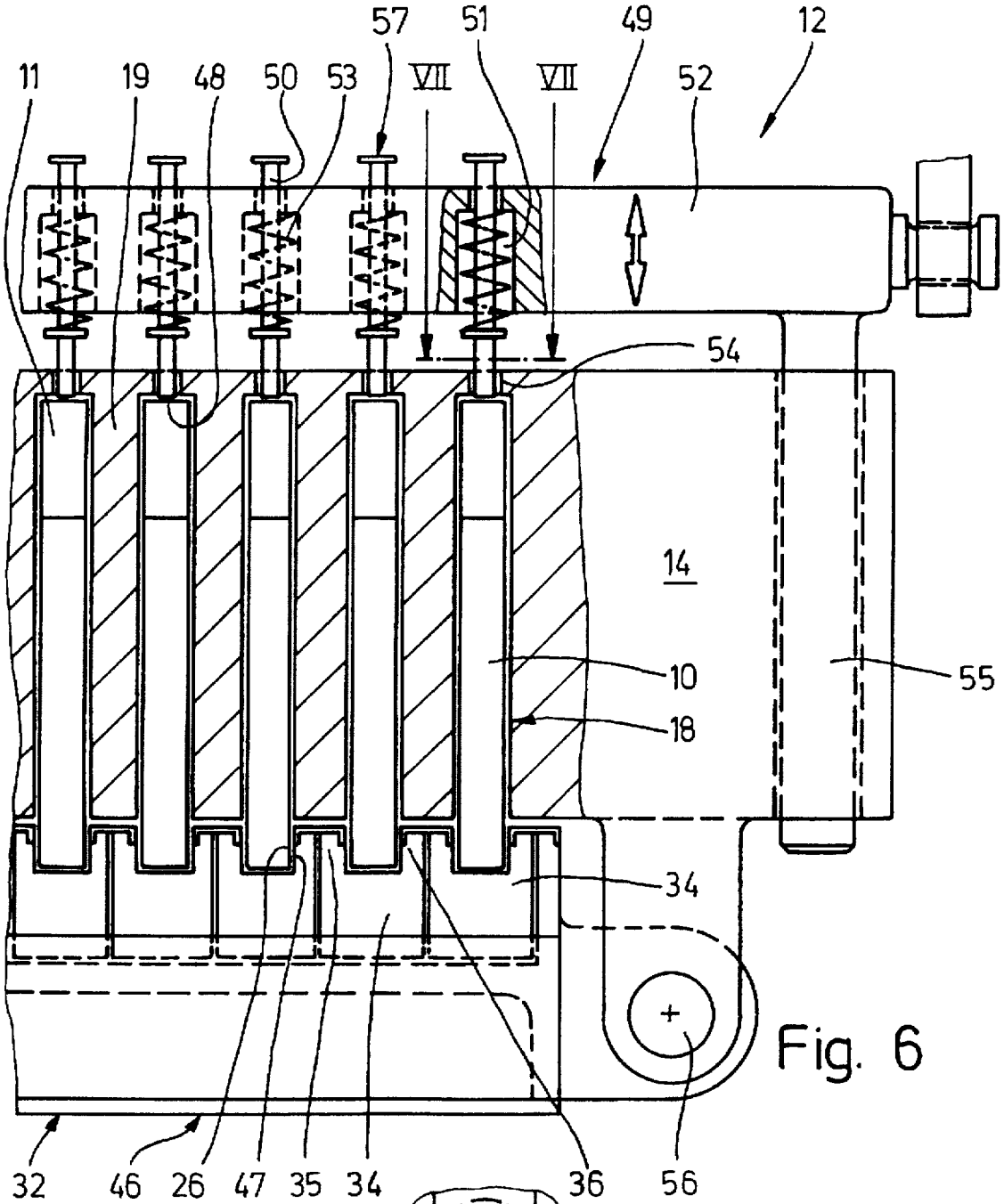
FIG. 6 shows a horizontal section through a region of a testing level inside of the cigarette magazine, on a greatly enlarged scale, according to a second embodiment of the invention.
Figure 7:
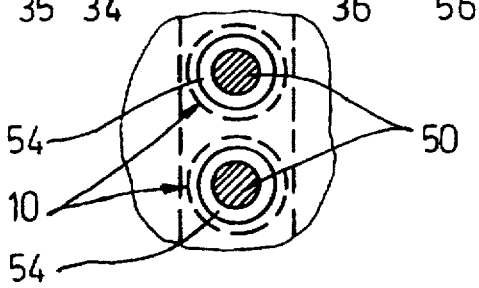
FIG. 7 shows a detail of a testing unit, specifically a section of an elongate testing unit.

A further preferred exemplary embodiment of the testing device is shown in FIGS. 6 and 7. In this embodiment, only one testing unit 46 is provided. This testing unit 46 is arranged at the testing level 20 on one side of the cigarette magazine 12 or the test channels 17. The testing unit 46 is assigned to the plain end faces of the cigarettes 10. The structure and the function of the testing unit 46 corresponds to the testing units 24, 25 of the exemplary embodiment of FIG. 2. Therefore, the same terms are used.

Opposite of the testing unit 46, on the other side of the cigarette magazine 12, a positioning unit 49 is arranged. The positioning unit 49 is assigned to the end faces 48 of the cigarettes 10 which are provided with filters 11.

The positioning unit 49 has a plurality of pressure members 57 which are arranged at distances from one another and which can be flexibly subjected to pressure. The pressure members 57 are designed as rams 50. The rams 50 are arranged in recesses 51 of a carrier 52 which accommodates the positioning unit 49. The rams 50 interact with springs 53 assigned thereto and ensure a flexible, individual pressure on the end faces 48 of the cigarettes 10 of a test group 45. The rams are arranged such that the cigarettes 10 or the end faces 48 thereof can be subjected to pressure in the longitudinal direction of the cigarettes 10. The longitudinal middle axes of the cigarettes 10, and the rams 50, almost overlap and extend almost parallel to one another. The rams 50 project into the test channels 17 through lateral orifices 54 of the magazine housing 14, and contact the end faces 48 of the cigarettes 10 in this manner.

With the help of the positioning unit 49 it is possible to compensate tolerances in the length of the cigarettes 10, or to avoid measuring inaccuracies in the testing of the cigarettes 10 resulting from tolerances in length. Due to the pressure exerted on the end faces 48 of the cigarettes 10 by the pressure members 57 or the rams 50, the end faces 47 flatly adjoin the testing unit 46 under pressure. Gaps between cigarettes 10 and the testing unit 46 are avoided. The conduction of external light to the receivers 30, 31 of the testing unit 46 is suppressed as a result of avoiding the gap between cigarettes 10 and testing unit 46. This ensures an accurate position of the cigarettes 10, independent of tolerances in the length of the same.

Corresponding to the design of the testing unit 46, the number of rams 50 is adjusted to the number of test channels 17. For each test channel 17 rams are provided according to the number of cigarettes 10 per cigarette group 45. In this exemplary embodiment, there are two rams per test channel 17 (FIG. 7) which are arranged on top of one another and at a distance from one another.

The positioning unit 49 is movable in the horizontal direction, in particular transversely relative to the cigarette magazine 12, and thus in the longitudinal direction of the cigarettes 10. For this purpose, the carrier 52 is displaceably mounted on both sides or ends with the guide rods 55 in a part of the magazine housing 14. The positioning unit 49 can be lifted off or retracted from the cigarette magazine by an actuating means which is not shown, such that the ends of the cigarettes 10 are exposed. The testing unit 46 located opposite of the positioning unit 49 is held in its position at the cigarette magazine. The positioning unit 49 is mounted in a pivot bearing 56 and can thus be lifted off from the cigarette magazine 12 by pivoting about the pivot bearing 56.

What is claimed is:

1. In a device for verifying correct formation of laterally directed opposite ends of cigarettes (10) in a region of upright test channels (17) in which respective individual cigarette rows (18) of superimposed cigarettes (10) are moved, from a top to a bottom of the test channels, wherein, in a region of a testing level (20), on at least one side of the test channels (17), a testing unit is arranged, and wherein the testing unit (24, 25) has sensors (28, 29, 30, 31), comprising transmitters (28, 29) and photosensitive receivers (30, 31), for transmitting and receiving a test light beam in a region of opposite end faces (27) of a test group (45) of the cigarettes and their adjacent side faces, the improvement wherein:

a) the sensors (28, 29) of the testing unit (24, 25) are located adjacent the opposite end faces (27) of the cigarettes (10) of a test group (45);

b) in a region of the testing unit (24, 25), each end face (27) of the cigarettes (10) of the test group (45) is associated with a separate one of said transmitters (28, 29);

c) the photosensitive receivers (30, 31) respectively extend entirely over the end faces (27) of superimposed cigarettes (10), adjacent to the end faces (27);

d) in the region of the testing unit (24, 25) the superimposed cigarettes (10) are associated with a common one of the receivers (30, 31) at both sides;

e) the photosensitive receivers (30, 31) extend almost over the entire height of the superimposed cigarettes (10) of the test group (45); and f) the photosensitive receivers (30, 31) receive light emitted from each of the cigarettes (10) of a test group (45).

2. The device as claimed in claim 1, characterized in that the cigarettes (10) of a test group (45) are successively verified in a region of the common receiver (30, 31) and are subjected to light from separate ones of the transmitters (28, 29).

3. The device as claimed in claim 2, characterized in that the receivers are planar receivers (30, 31) with light-sensitive receiving surfaces arranged at both sides of the cigarettes to be verified, and one transmitter (28, 29) is arranged on each end face (27).

4. The device as claimed in claim 1, characterized in that transmitters (28, 29) and/or receivers (30, 31) are arranged on a common testing member (33), and are covered with a translucent layer.

5. The device as claimed in claim 1, characterized in that the testing unit (24, 25) is comprised of a plurality of testing members (33) arranged next to one another for one test group of cigarettes each, the testing members (33) being releasably connected to one another and with the testing unit (24, 25) or a common carrier (32) thereof.

6. The device as claimed in claim 5, characterized in that each testing member (33) has a U-shaped ground plan and a body (34) for the accommodation of the transmitters (28, 29), and legs (35, 36) extending adjacent to the ends of the cigarettes (10) for the accommodation of one receiver (30, 31) each.

7. The device as claimed in claim 6, characterized in that the testing members (33) are connected to one another in a region of free ends of the legs (35, 36) by connecting means, U-profiles (39).

8. The device as claimed in claim 7, characterized in that the testing members (33) are connected to the carrier (32) of the testing units (24, 25) by means of releasable connecting means which also connect the U-profiles (39) to the legs (35, 36) at the same time.

9. The device as claimed in claim 1, characterized in that the test channels (17) are in a magazine (12), and the testing unit (24, 25) is movable transversely relative to the cigarette magazine (12), and is retracted from the cigarette magazine (12) during a downward movement of the cigarettes (10), and adjoins the cigarette magazine (12) during a test cycle.

10. The device as claimed in claim 9, characterized in that the testing unit (24, 25) is mounted pivotably about a laterally arranged pivot bearing (44) with a vertical axis of rotation, such that the testing unit (24, 25) can be entirely pivoted away from the cigarette magazine (12) by a pivoting movement.

11. Device for verifying the ends of cigarettes (10) in a region of upright test channels (17) in which respective individual cigarette rows (18) of superimposed cigarettes (10) are moved from the top to the bottom with their laterally directed ends, in a cigarette magazine (12) of a packaging machine, wherein, in a region of a test plane (20), on one side of the test channels (17), a testing unit (46) is arranged with sensors (28 to 31), comprising transmitters (28, 29) and receivers (30, 31), for transmitting and receiving a test beam in a region of end faces of a test group (45) of the cigarettes (10), and their adjacent side faces, characterized in that a positioning unit (49) for flexibly and individually exerting pressure onto the cigarettes is arranged on a side of the testing channels (17) that is opposite the testing unit (46).

12. The device as claimed in claim 11, characterized in that the positioning unit (49) is provided with pressure members (57) which are arranged at a distance from one another, and which can be flexibly subjected to pressure, the number of pressure members (57) being coordinated with the number of cigarettes (10) per test group (45) for each test group (45).

13. The device as claimed in claim 12, characterized in that the positioning unit (49) can be transversely moved on guide rods (55), and the testing unit (46) is pivotably mounted on a pivot bearing (44) such that the positioning unit (49) and the testing unit (46) can be lifted off or pivoted away from the cigarette magazine (12).

* * * * *